US005158502A

United States Patent [19]

Frost

[11] Patent Number: 5,158,502

[45] Date of Patent: Oct. 27, 1992

[54] ROOF RIDGE VENT SYSTEM FOR BUILDINGS

[76] Inventor: Richard Frost, 1201 Grace Ave. SW., Willmar, Minn. 56201

[21] Appl. No.: 729,163

[22] Filed: Jul. 12, 1991

[51] Int. Cl.[5] ..... F24F 7/02

[52] U.S. Cl. ..... 454/364; 236/46 R

[58] Field of Search ..... 49/339, 340; 98/42.18, 98/42.2; 236/46 R

[56] References Cited

U.S. PATENT DOCUMENTS

| | | | |
|---|---|---|---|
| 2,584,591 | 2/1952 | Galeazi . | |
| 3,323,438 | 6/1967 | Korff . | |
| 3,474,761 | 10/1969 | Thomason | 119/21 |
| 4,151,811 | 5/1979 | Truhan | 119/21 |
| 4,381,731 | 5/1983 | Dill | 119/21 |
| 4,574,737 | 3/1986 | Bugeja | 119/21 X |
| 4,597,324 | 7/1986 | Spilde | 98/42.16 |
| 4,672,889 | 6/1987 | Lynch | 98/42.2 |
| 4,683,811 | 8/1987 | Huisinga et al. | 98/42.2 |
| 4,817,506 | 4/1989 | Cashman | 98/42.21 |

FOREIGN PATENT DOCUMENTS

| | | | |
|---|---|---|---|
| 36310 | 7/1886 | Fed. Rep. of Germany | 98/42.2 |
| 2910447 | 9/1980 | Fed. Rep. of Germany | 98/42.2 |
| 620640 | 5/1966 | Italy | 98/42.2 |

*Primary Examiner*—Harold Joyce
*Attorney, Agent, or Firm*—Hugh D. Jaeger

[57] ABSTRACT

An adjustable ridge cap for a roof ridge vent system to control exhaust air at peak of buildings. An adjustable ridge cap raises and lowers on demand according to temperature. A single source power unit attaches to a hinge plate which pivots to raise and lower all connecting ridge cap sections as one single unit.

3 Claims, 4 Drawing Sheets

ROOF RIDGE VENT SYSTEM FOR BUILDINGS

BACKGROUND OF THE INVENTION

1. Field of the Invention

The present invention relates to a ridge ventilation system for an agricultural or farm building, and more particularly, relates to a movable ridge cover for a poultry or animal barn, such as swine, horses, beef, dairy, housing facilities or greenhouses 2. Description of the Prior Art Ventilation systems are extremely important in the care of plants or animals sheltered in farm buildings. Both plant green houses and animal barns need to be properly ventilated to maintain correct temperatures and to allow the escape of any type of gases or heat from the shelters.

Many ventilation systems have been created for poultry barns in particular. For example, side curtains have been used to vary the air flow.

Many attempts have been made to use roof ridge venting. Stationary roof vents are very common, even in residential housing. In animal shelters, the roof vent may be used year round, due to the large amount of heat generated by animals in the barn.

Various attempts have been made to use flaps which close over a ridge vent opening. The prior art devices are impractical for many reasons. They often use air cylinders and air hoses which cause maintenance problems due to possible leakage. They are only usable in short sections along the roof vent requiring multiple power drivers to open the flaps.

The flap-type roof vent enclosures are also unsuitable in that they only keep out precipitation when they are in the closed position. When using flap-type covers, it is difficult, if not impossible to vary the amount of opening for ventilation purposes Prior art devices are typically either entirely open or entirely closed.

What is needed is a roof vent which shelters the ridge vent opening from precipitation in either its open or closed position, has variable openings for controlling the amount of ventilation, is openable in one section for the entire ridge vent, and has a practical control for raising and lowering the cover.

The present invention overcomes the disadvantages of the prior art by providing a roof ridge vent system.

SUMMARY OF THE INVENTION

The general purpose of the present invention is a ventilation system for covering the roof ridge having an elongated vent opening along the ridge. A long cap extends over a ridge vent opening, protecting it from precipitation. The cap lies in a generally horizontal plane. The cap is movable from a first closed position tightly covering the vent opening to a second elevated position in which circulation occurs through the vent opening and out either side of the cap. The system includes a drive system for moving the cap between first and second positions. The cap is preferably adjustable to any position between the first and second positions. The drive system is preferably an electric linear actuator powered to move the cap. The cap is supported by a series of hinge plates so that the weight of the cap is not integral to the drive system.

In the preferred embodiment, movement from the first and second positions is accomplished by integral hinge plates. Each hinge plate is rotatably mounted to the cap and to the vent opening so that in the closed position the hinge plates lie at an acute angle to the cap. When moved to the open position, the hinge plates are generally substantially perpendicular to the cap, and support the cap away from the roof vent opening.

The present invention is infinitely variable between a closed position and the open position, allowing fine tuning of ventilation in the building. The caps are constructed to form a continuous element for the entire ridge and joined together at the appropriate points. This simplifies operation of the vent system. One drive system is thereby used to move the entire cap upward. Even when the cap is in the full open position, the cap protects the vent opening from precipitation.

Significant aspects and features of the present invention include a continuous ridge cap to keep out rain and snow; a ridge cap which is adjustably opened and closed according to temperature; a ridge cap that can be manually opened and closed in case of power failure; a ridge cap which opens and closes as a single unit for a more uniform air flow; and a system which uses less power to open and close.

Another significant aspect and feature of the present invention is a ridge cap to keep snow and rain from falling directly into the building. Having thus described embodiments of the present invention, it is a principal object hereof to provide a roof ridge vent system for a building, such as a farm building.

Objects of the present invention include a ridge cap raising and lowering as a single unit; a ridge cap that opens and closes from a power unit or a hand winch; a hinge plate that pivots to raise and lower the ridge cap; and adjustably opened, closed and minimum ventilation positions for the ridge cap.

BRIEF DESCRIPTION OF THE DRAWINGS

Other objects of the present invention and many of the attendant advantages of the present invention will be readily appreciated as the same becomes better understood by reference to the following detailed description when considered in connection with the accompanying drawings, in which like reference numerals designate like parts throughout the figures thereof and wherein.

DETAILED DESCRIPTION OF THE PREFERRED EMBODIMENTS

Figure 1:
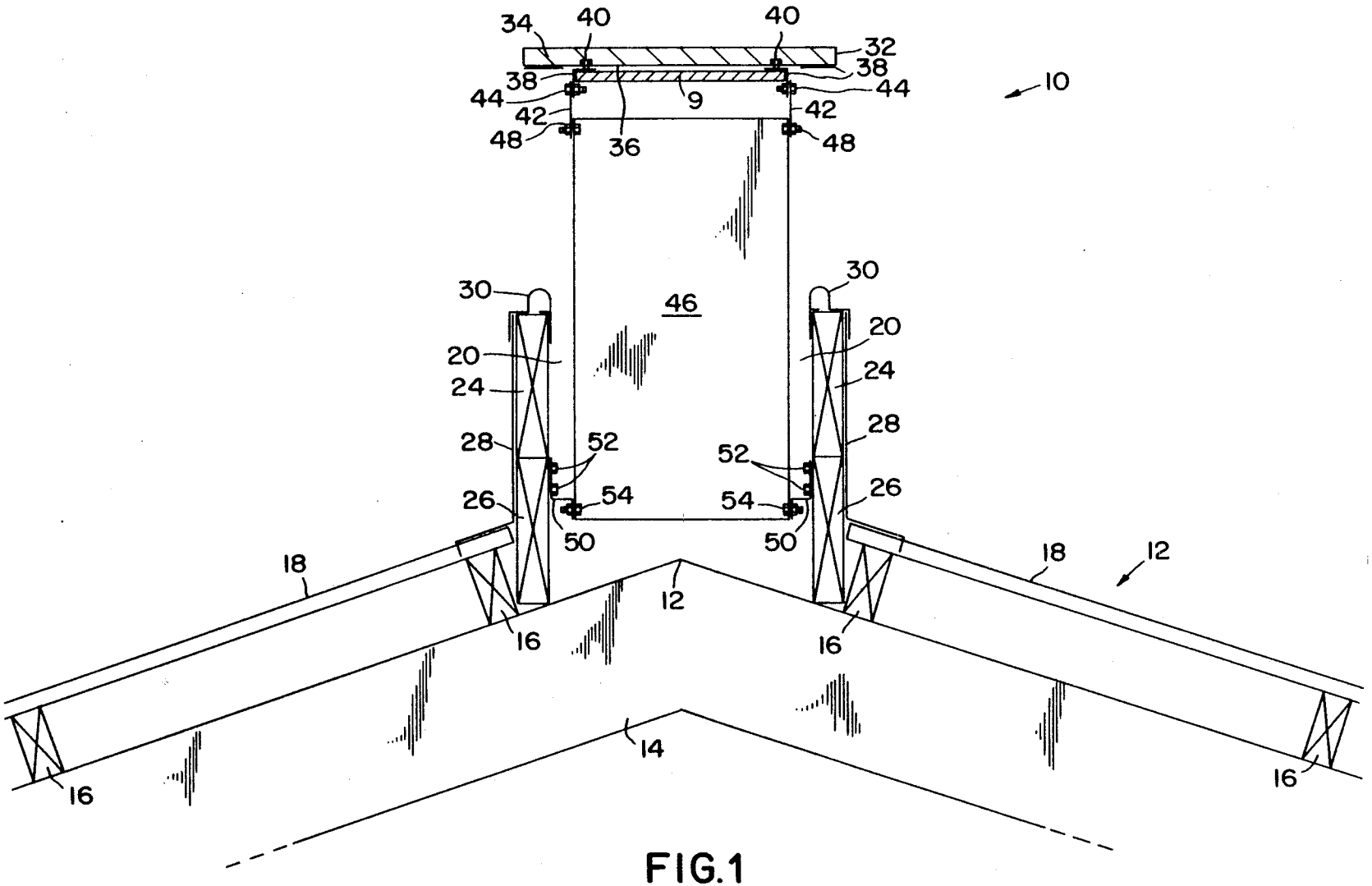
FIG. 1 illustrates a cross-sectional view of a ridge ventilation system constructed according to the present invention shown in the raised position.
Figure 2:
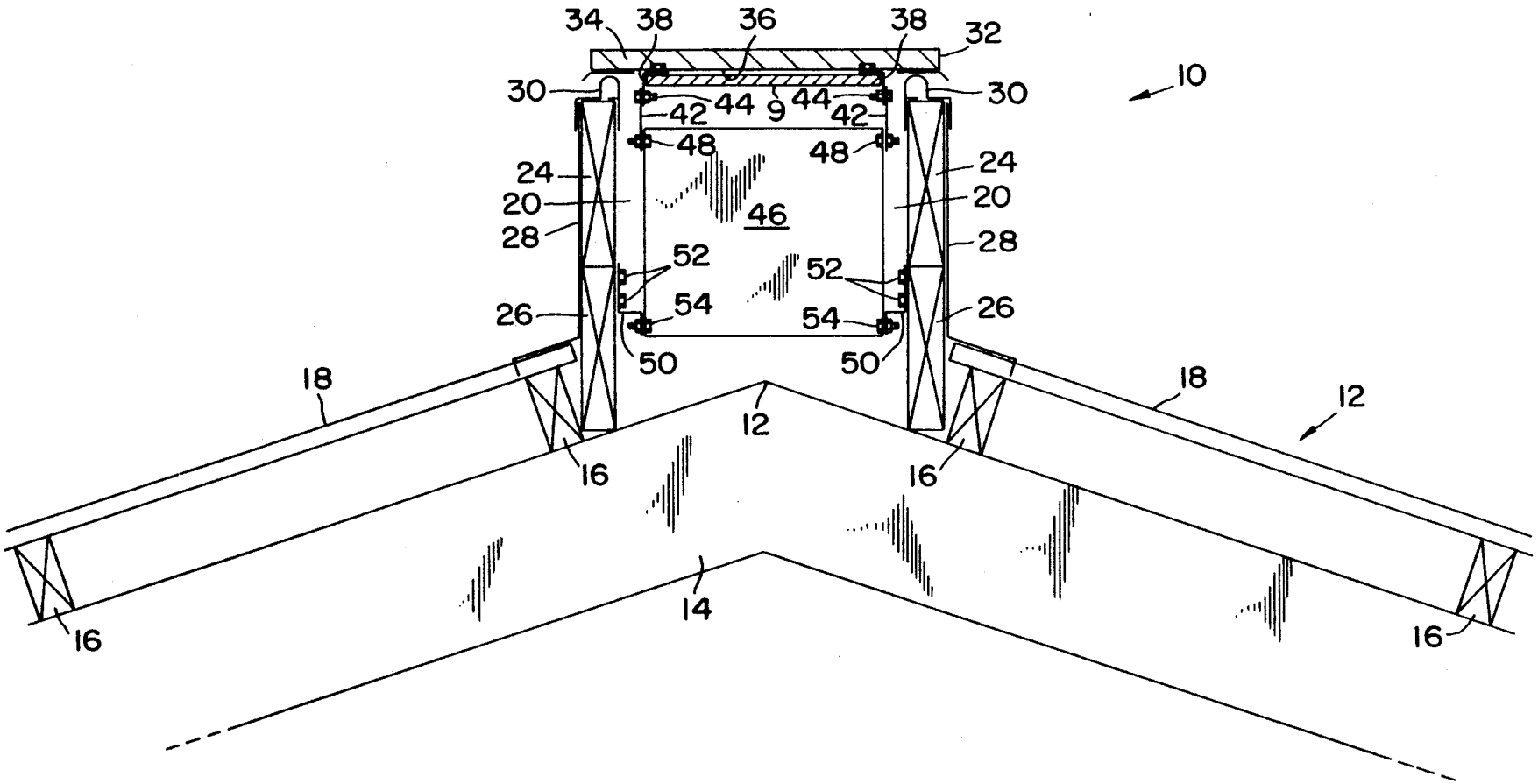
FIG. 2 illustrates the system of FIG. 1 in the closed position.

The ventilation system 10 of the present invention is shown in FIGS. 1 and 2 mounted on a barn 12. The illustrated barn 12 uses conventional roof truss construction as the mode of illustration. The present invention is suitable for any such structures having a ridged roof. A particular structure of which the present embodiment is constructed is a poultry barn; however, the vent system 10 is suitable for any other 0 type of animal structure. Additionally, a ventilation system of the present invention can be adopted by those skilled in the art to other structures for protecting plants, such as green houses, garage, pole buildings or other like structures.

The illustrated barn 12 includes roof trusses 14, roof framing 16, and roofing 18. A vent 20 is provided along the entire length of ridge 22 of barn 12.

In the illustrated embodiment, the vent 20 is framed in by a chimney 24. In the illustrated embodiment, chimney framing 24 is made of dimension lumber 26 covered by flashing 28.

Chimney 24 then forms a long rectangular box the entire length of ridge 22. Each side of the chimney framing 24 is capped by a seal 30, preferably made of PVC.

Barn ventilation is provided in that heated air rises upward between the roof trusses 14, along the underside of the roofing 18 and out the vent 20.

The vent system 10 is designed to vary the escape of heated air out of the vent 20, as well as keeping precipitation from entering downwardly into the vent 20.

The vent system 10 includes a rectangular shaped cap 32, which in the preferred embodiment is a long U-shaped channel made of PVC. The cap 32 is preferably filled with insulation 34. The lower end of the U-shaped channel of the cap 32 is covered by a liner panel 36.

The cap 32, insulation 34 and liner panel 36 are supported by a pair of side rails 38. The side rails 38 are inverted L-shaped elements extending generally the entire length of the cap 32. A cross support also attaches to like opposing side rails 38 to support the cap 32 and insulation 34. There are five of these per 8′ section. In the preferred embodiment, the cap 32 is attached to rails 38 by bolts 40.

Spaced along rails 38 are opposing splice plates 42, which splice or connect each successive rectangular shaped cap 32 and associated members to form an essentially continuous cap member along the length of the building roof peak 12. Splice plates 42 are attached to side rails 38 by bolts 44.

A hinge plate 46 is rotatably mounted between the opposing splice plates 42 by bolts 48.

At its lower end, hinge plate 46 is rotatably mounted to the chimney 24 by plates 50 which are Z-shaped angle plates. The plates 50 are mounted on the chimney 24 by means of lag bolts 52, and are rotatably mounted to hinge plate 46 by bolts 54.

FIG. 2 illustrates the vent system 10 in a closed position where cap 32 is lowered against seal 30 to close vent 20 where all numerals correspond to those elements previously described. In this position, the top of the hinge plate 46 is shown rotated away the viewer so that it is at an acute angle to cap 32.

MODE OF OPERATION

Figure 3:
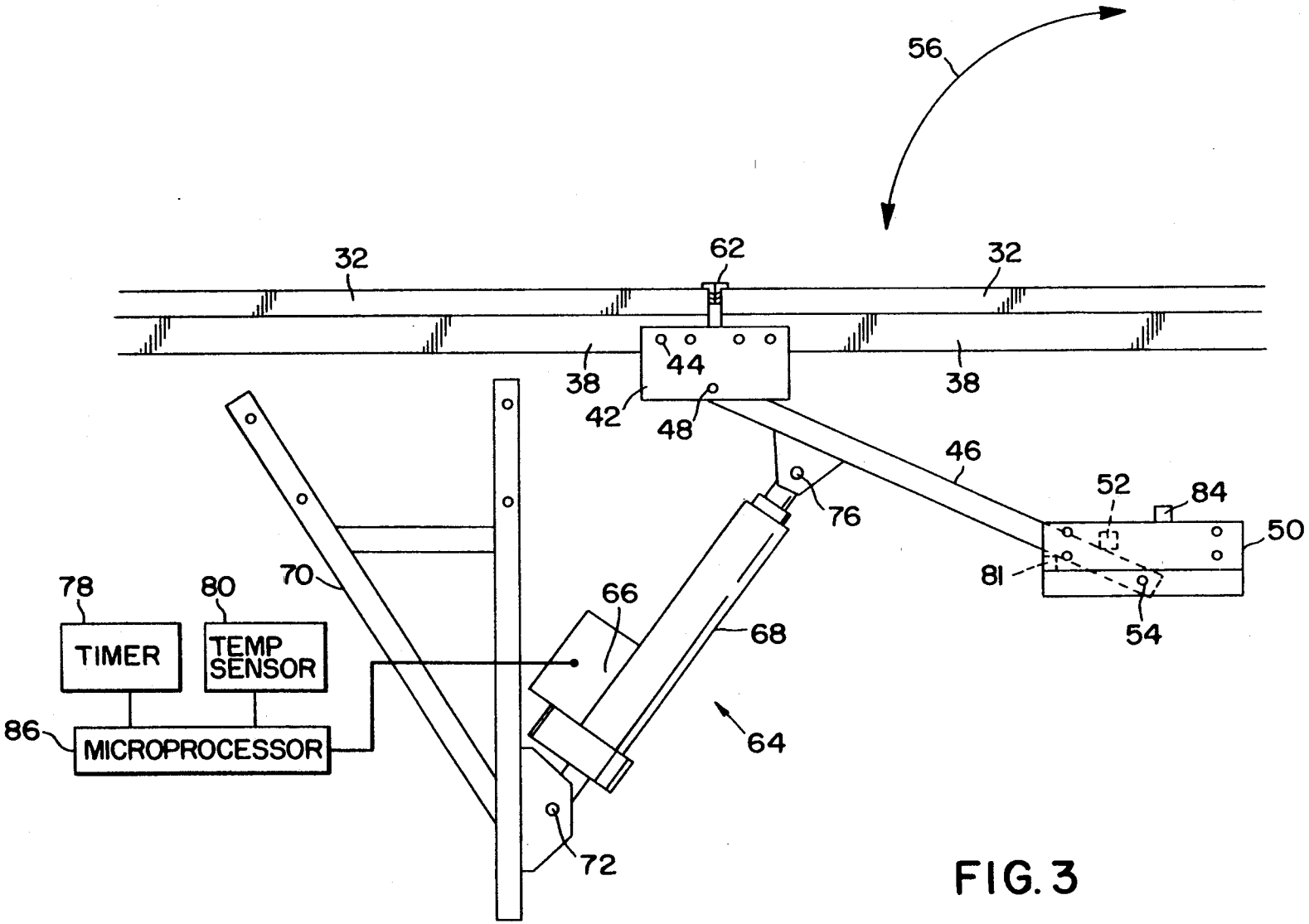
FIG. 3 is a side view of the system of FIG. 1 in the lowered position; and, FIG. 4 is a side view of the system of FIG. 1 in the elevated position.
Figure 4:
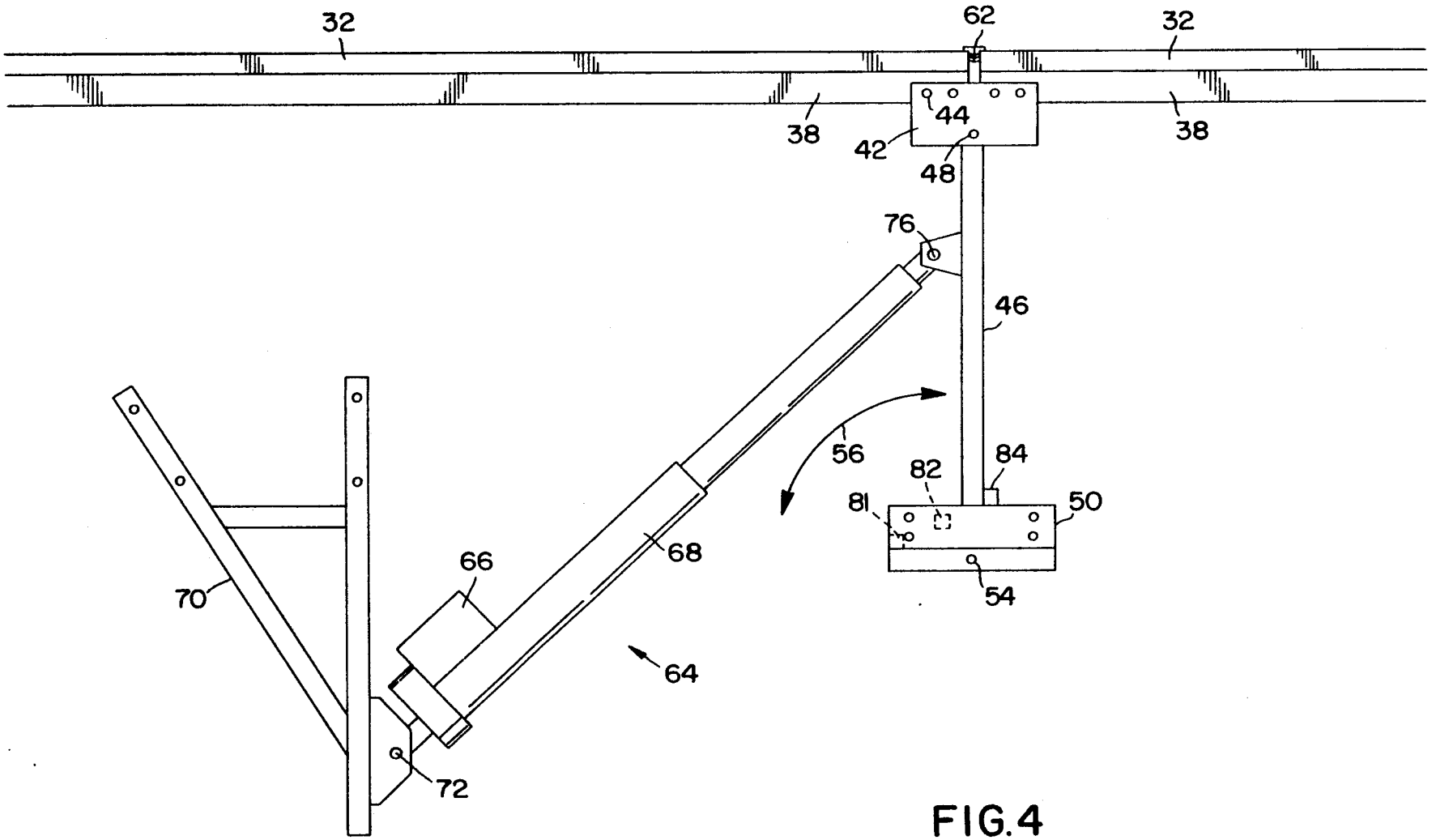

Operation of vent system 10 is best illustrated in FIGS. 3 and 4, which illustrate the movement of roof system 10. In FIG. 3, a side view of the system of FIG. 1, the movement of vent system 10 is indicated by curved arrows 56. All numerals correspond to those elements previously described.

FIGS. 3 and 4 illustrate a number of caps 32 which are spliced together by splicing plates 42. At their intersection, the gap between the caps 32 are sealed by a dual durometer 62. By using this structure, constructed according to the present invention, has one essentially continuous cap 32 extending the entire length of ridge 22.

A drive system 64 is shown in FIGS. 3 and 4. The drive system 64 includes a power unit 66, a power unit actuator 68, a power unit support frame 70, a power unit pivot 72, and a hinge plate pivot 76 connected to the hinge plate 46. The support frame 70 and a corresponding opposing mirror image support frame (not illustrated) are mounted by lag bolts to chimney frame 24. The hinge plate 46 is mounted to the opposing splice plates 42 and the opposing plates 50.

In the preferred embodiment, the power unit 66 is an electric linear actuator, and the actuator 68 is a screw type cylinder which extends and contracts to alter the height of the connected caps 32. The power unit 66 and actuator 68 are pivotally mounted to support the frame 70 by the pivot 72. The power unit 66 and the actuator 68 are also pivotally mounted to the hinge plate 46 by the pivot 76.

FIG. 4 illustrates a side view of the system of FIG. 3 in the elevated position where all numerals correspond to those elements previously described. When actuator 68 extends, the power unit hinge plate 46 is moved to the vertical position. This raises the connected caps 32 in the air as illustrated by arrow 56 to allow ventilation through the vents 20 of FIG. 1. When the hinge plate 46 is moved to vertical, all the adjacent hinge plates 46 follow and raise to support the caps 32 in the position to which they are moved by the actuator 68. The adjacent hinge plates 46 are not directly actuated by and are actuated through the linkage formed by the caps 32 and their associated components.

The drive system 64 is illustrated in terms of an electric linear actuator system, however, any other drives may be selected by those skilled in the art, such as air drives, chain and sprocket systems, etc. While the present invention may be practiced with the cap 32 which only moves between open and closed positions, it is preferable that drive system 64 be selected so that it may provide an infinite range of positions between the open and closed position.

The preferred embodiment includes a timer 78 which is shown schematically in FIG. 3. The timer 78 may be any commercially available timer selected by those skilled in the art to program the power unit 66 for raising and lowering cap 32 according to a predetermined schedule. That is, the farmer can program the caps 32 to be fully raised during the heat of the day, partially raised during other daylight hours and closed at night, for example. Also illustrated is a temperature sensor 80 which is schematically illustrated. Temperature sensor 80 determines the temperature within barn 12.

The temperature sensor 80 is electrically connected &:o power unit 66, and signals the power unit 66 when the temperature has reached the point requiring elevation of the caps 32. The temperature sensor 80 may be programmed to not only open and closed cap 32, but to determine the amount of opening of cap 32 based upon barn temperature.

The drive system 64 is also equipped with limit switches 81, 82 and 84, which are electrically connected to the power unit 66. In the preferred embodiment, the limit switch 81 is a closed-position limit sensor which signals the power unit 66 to cease lowering the actuator 68 when the cap 32 is closed. The limit switch 84 is an upper limit switch for signalling the power unit 64 that the cap 32 is in the full upright position. The limit switch 82 is a minimal opening switch which signals the power unit 66 when it has reached a desired minimum air ventilation level. The farmer may adjust the switches 81, 82 and 84 as needed. In particular, the switch 82 may be set and the power unit 66 programmed so that when the power unit 66 determines that it is time to move to a fixed minimum opening, the limit switch 82 determines the height of the cap 32.

The limit switches 81–84 are only exemplary of the switching mechanisms that may be used by those skilled in the art. For example, a inclinometer or other such device may be used for measuring the angle deflection of the hinge plate 46 from vertical in order to program the power unit 66.

The benefits of vent system 10 over the prior art are manifold. The key to the present invention is its simplicity in order to accomplish total venting without multiple mechanisms. The assembly of caps 32 into a unified ridge vent greatly improves over the prior art systems of individual flaps. By having a vent system which raises and lowers vertically, while keeping its position over the vent 20, cap 32 is always in the position to deflect precipitation from vent 20.

Unlike other venting systems, a single drive system 64 elevates the entire linkage of caps 32, adjusting ventilation along the entire ridge 22 for consistent air flow within the barn 12.

The system as illustrated allows great flexibility in building ventilation management. The system may be controlled by a timer 78 to automatically adjust air circulation at various times a day. Also this may be combined with temperature sensor 80 to allow for automatic adjustment for temperature within the barn. Similarly, a default open position may be set by the limit switches.

In one preferred embodiment, a microprocessor 86 is included for processing the various inputs. A combination of time of day, temperature of the building, and limit switch input may be correlated by power unit 66 to find the optimum ventilation. For example, the timer 78 can signal the power unit 66 that it is on the daylight schedule and that adjustments from temperature sensor will have a desired effect. During night time hours, a different schedule may be set so that input from the temperature sensor 80 will be interpreted according to a night time schedule.

The control system of the present invention allows total management of ventilation up through the ridge vent of a barn, greenhouse, or other ridged building.

Various modifications can be made to the present invention without departing from the apparent scope hereof.

I claim:

1. A roof ridge vent system for a housing comprising:

a. a roof ridge having an open vent formed by an elongate chimney at a peak of the ridge above roof trusses;

b. a cap sized to cover and overlap the open vent, the cap being mounted on the ridge for movement between a first position tightly contacting the ridge and a second elevated position above and spaced apart from the ridge, wherein the cap is over the open vent for protecting the open vent from precipitation while allowing ventilation;

c. a hinge plate pivotally mounted to the cap at a top end and pivotally mounted to either side of the chimney at its lower end for pivotal movement within the chimney in either direction from the first position to the second position; and, d. drive means for moving the cap between the first and second positions.

2. A cap roof ridge ventilation on a structure having a vent opening along a roof ridge comprising:

a. a cap for covering the vent opening, the cap having a top surface generally parallel to a horizontal plane;

b. at least two hinge plates rotatably mounted on the cap and rotatably mounted on the roof ridge for supporting the cap in a first closed position against the ridge where the hinge plates are at an acute angle for the plane of the cap and in a second raised position where the hinge plates are generally perpendicular to the plane of the cap;

c. drive means for moving the cap between the first and second positions;

d. a power unit for controlling the drive means and for receiving signals indicative of cap positioning, and a timer for storing a program of times and for providing a signal to the power unit indicative of cap position relative to stored times.

3. The system of claim 2 further comprising a temperature sensor electrically connected to the drive unit for sensing ambient temperature and providing a signal to the power unit indicative of cap position based upon the sensed temperature.

* * * * *